United States Patent [19]

Sirvet

[11] Patent Number: 4,928,511

[45] Date of Patent: May 29, 1990

[54] ROTARY CUP INFEED

[75] Inventor: Enn Sirvet, Washington Township, N.J.

[73] Assignee: Sequa Corporation, New York, N.Y.

[21] Appl. No.: 283,678

[22] Filed: Dec. 13, 1988

[51] Int. Cl.[5] ..... B21D 43/04; B21D 43/16; B21D 43/20

[52] U.S. Cl. ..... 72/361; 72/421; 72/424; 72/428; 414/797.7

[58] Field of Search ..... 72/361, 349, 421, 424, 72/428, 3, 4; 10/155 R, 155 A, 169; 413/3, 50, 76; 414/797.7

[56] References Cited

U.S. PATENT DOCUMENTS

| | | | |
|---|---|---|---|
| 2,098,260 | 11/1937 | Smith | 209/121 |
| 2,266,807 | 12/1941 | Rooney | 209/121 |
| 2,301,682 | 11/1942 | Candee et al. | 72/3 |
| 2,339,008 | 1/1944 | Gladfelter et al. | 91/45 |
| 2,502,459 | 4/1950 | Huntar | 414/797.7 |
| 2,539,467 | 1/1951 | Pechy | 414/797.7 |
| 2,663,275 | 12/1953 | Collins | 72/4 |
| 2,681,026 | 6/1954 | Zajic | 72/4 |
| 2,696,296 | 12/1954 | Simpson et al. | 209/82 |
| 2,919,801 | 1/1960 | Pechy | 209/111 |
| 3,289,453 | 12/1966 | Wyle et al. | 72/349 |
| 3,628,368 | 12/1971 | Cvacho et al. | 72/361 |
| 3,715,905 | 2/1973 | Paramonoff | 72/349 |
| 3,802,364 | 4/1974 | Paramonoff | 113/115 |
| 3,822,576 | 7/1974 | Hardt | 72/348 |
| 4,061,012 | 12/1977 | Wessman | 72/347 |
| 4,223,544 | 9/1980 | Main | 72/349 |
| 4,534,202 | 8/1985 | Snyder | 72/349 |

*Primary Examiner*—Robert L. Spruill

*Attorney, Agent, or Firm*—Mitchell D. Bittman; Jerome M. Berliner

[57] ABSTRACT

Apparatus for forming elongated metal cans from relatively short cups by utilizing a reciprocating ram to drive the cups one at a time through a die pack, is provided with a continuously rotating feeder that transfers the cups from the exit of a gravity feed chute to a receiving station where each cup is indexed for engagement by the ram as it moves forward in its working stroke. The feeder rotates through one complete revolution for each forward-return cycle of the ram and during each revolution thereof a pocket in the feeder receives a cup from the chute, which cup then moves along a curved guideway to a receiving station. Prior to being engaged by a registry formation at the receiving station the cup is engaged by a stripper that removes the cup from the feeder pocket. The feeder continues to drive the cup toward the registry formation while the cup is being stripped from the feeder pocket. A formation on the feeder maintains the cup in engagement with the registry formation while the cup is initially engaged by the ram during forward movement thereof.

29 Claims, 5 Drawing Sheets

10
51
40
204
207
203
CLUTCH
209
206
BRAKE
MAIN DRIVE
202
41
[FROM SENSOR 208 (FIG. 2)]
205
31
30
24
35
33a

ROTARY CUP INFEED

BACKGROUND OF THE INVENTION

This invention relates to cup infeeders and more particularly relates to a continuously rotating feeder which transports cups to a receiving station where the cups are indexed for engagement by a reciprocating tool that moves parallel to the axis of rotation for the rotating feeder The main section or body of a so-called two piece metal container includes an elongated cylindrical sidewall, an integral bottom and an open top. Such bodies are often formed in drawing and ironing machines of the type described in the E. Paramonoff, U.S. Pat. No. 3,704,619 issued Dec. 5, 1972 and U.S. Pat. No. 3,735,629 issued May 29, 1973 entitled, respectively, Redraw Blankholder positioning Mechanism for Cup-Shaped Article Formers Such as Metallic Can Body Formers and the Like and Apparatus for Forming One Piece Metallic Can Bodies. Such machines produce can bodies from blanks, in the form of shallow cups, by having a reciprocated ram drive each cup through a die pack which is a series of die elements having openings that are graduated so that the blank passes through the largest opening first and each subsequent opening that the blank is driven through is slightly smaller than the preceding opening through which the blank has been driven.

In prior art apparatus of this type the cups are transferred from a gravity feed chute to a receiving station through which the ram travels. A linearly reciprocated feed element is disclosed in U.S. Pat. No. 4,534,202 issued Aug. 13, 1985 to W. W. Snyder for Cup Feeding Mechanism, and a pivoted feed member is disclosed in U.S. Pat. No. 4,061,012 issued Dec. 6, 1977 to E. F. Wessman for a Drawing and Ironing Machine With Positive Cup Feeder.

Utilization of reciprocated and/or rocking type feed mechanisms severely limits production rates of prior art machines and often presented maintenance problems.

SUMMARY OF THE INVENTION

The instant invention overcomes the limitations which linearly reciprocated and rocking type feed mechanisms imposed on prior art drawing and ironing machines by providing a feed mechanism that comprises a single continuously rotating arm having a pocket that receives a blank as it is gradually lowered from a feed chute by a lead-in surface that extended into the pocket. The feed member positively moves the cup along an arcuate guide and into a receiving station where the blank is positioned for engagement by the ram as it moves forward in its working stroke. A stationary stripper removes the blank from the pocket upstream of the receiving station means but the feed member continues to positively drive the blank to engagement with registry means at the receiving station. When the blank engages the registry means a portion of the feed member cooperates with the registry means to hold the blank in registered position until it is engaged by the ram and/or by a movable clamping pad that reciprocates in association with the ram.

OBJECTS OF THE INVENTION

Accordingly, the primary object of the instant invention is to provide a continuously rotating mechanism for feeding blanks to a receiving station through which tool means operates.

Another object is to provide feeding means of this type that is adapted for a drawing and ironing machine which transforms metal cups into one piece can bodies.

Still another object is to provide a feeder of this type that rotates through a complete revolution for each operation of a reciprocated ram that engages a workpiece which is delivered by the feed member after being released by the latter.

A further object is to provide a feed mechanism of this type having means that cooperates with registry means to hold a blank in position for engagement by a tool.

A still further object is to provide a feed mechanism of this type which limits abrupt movement of the blanks that are disposed within a gravity feed chute.

These objects as well as other objects of this invention shall become readily apparent after reading the following description of the accompanying drawings in which:

DETAILED DESCRIPTION OF THE EMBODIMENT

Figure 1:
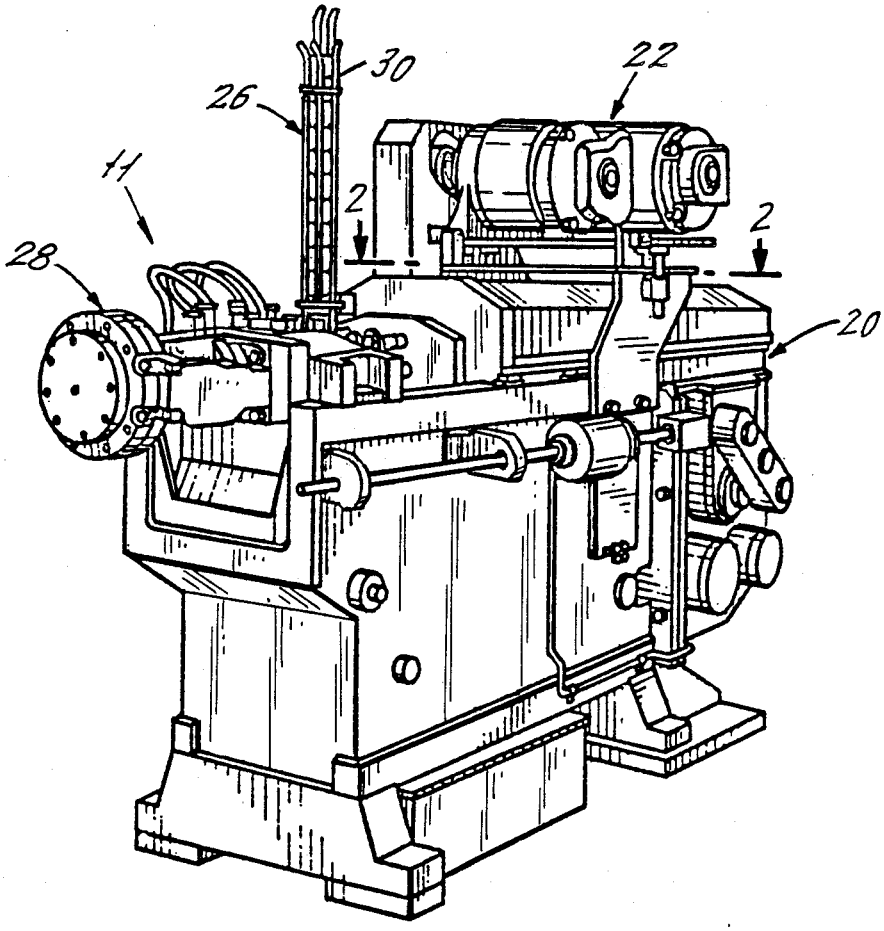
FIG. 1 is a perspective of a cup-shaped article forming machine incorporating the continuous rotary feed mechanism constructed in accordance with the instant invention.

Now referring to the Figures. Rotary feed mechanism 10 (FIG. 3) of this invention is incorporated in otherwise conventional drawing and ironing machine 11 of FIG. 1. The latter includes main frame 20 having main drive mechanism 22 mounted thereon for reciprocating ram 24 (FIG. 2) along a horizontal feed path from a rearward reversing position (FIG. 5) forwardly through receiving station 25 of feeding mechanism 10, the forward direction being from right to left with respect to FIG. 2. Forward of feeding mechanism 10 ram 24 passes through die pack 28 and, upon reaching the position illustrated in FIG. 2, reverses and returns to the position illustrated in FIG. 5.

Figure 2:
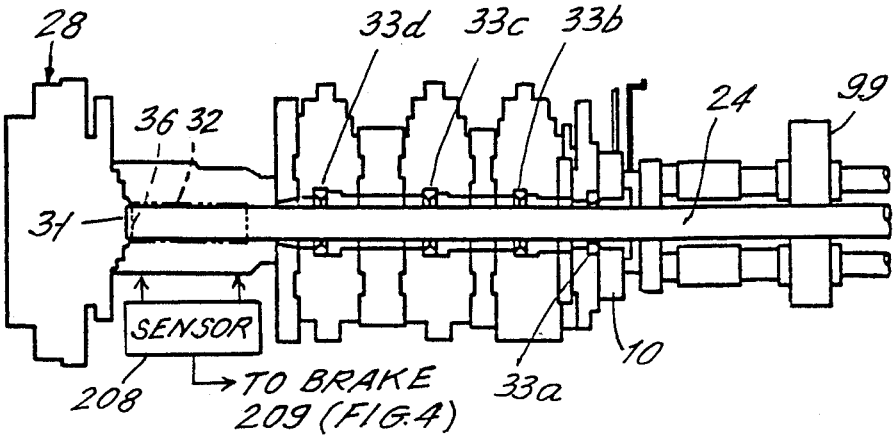
FIG. 2 is an enlarged fragmentary somewhat diagrammatic view of the die pack section in the machine of FIG. 1 looking in the direction of arrows 2—2 of FIG. 1 with the ram and redraw blank holder pad in their forward or can body forming positions.
Figure 5:
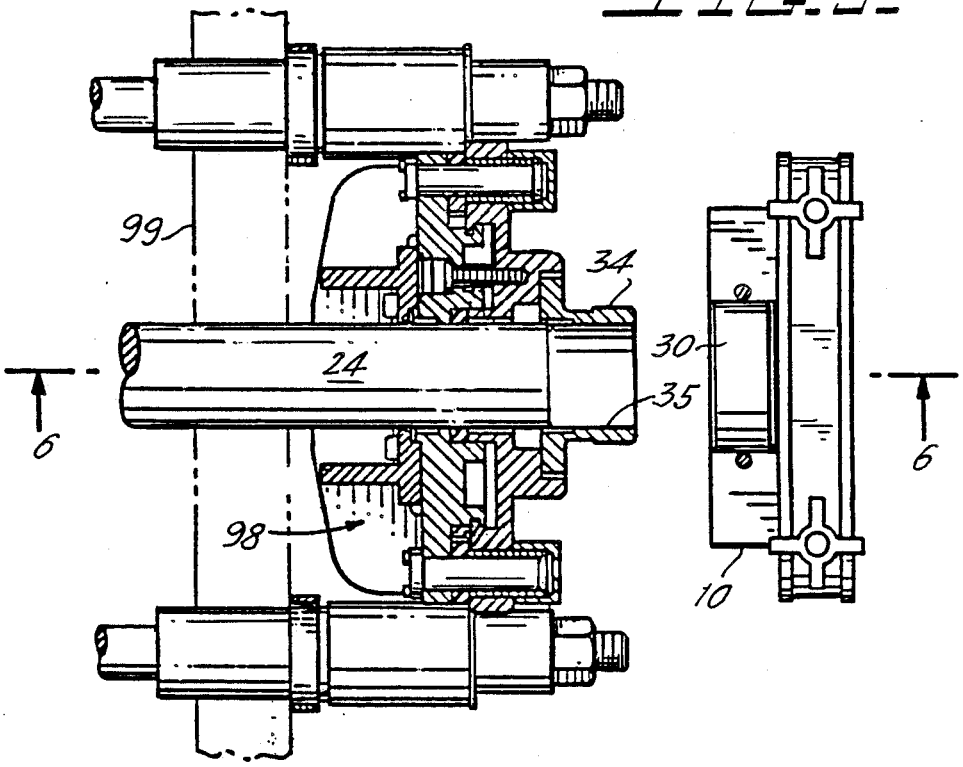
FIG. 5 is an enlarged fragmentary horizontal section showing the ram and blank holder pad of the tool means retracted prior to engagement with a blank.
Figure 6:
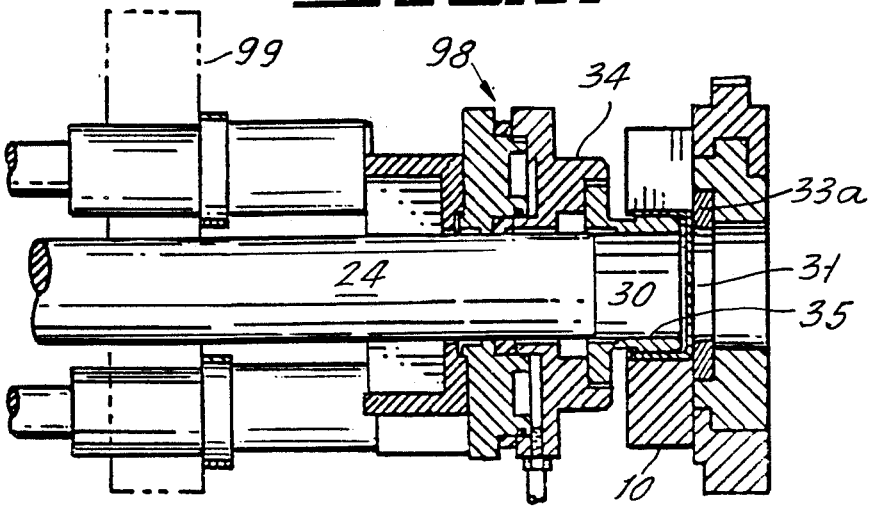
FIG. 6 is a cross-section taken through lines 6—6 of FIG. 5 looking in the direction of arrows 6—6 with the blank holder pad in its forward clamping position

Body former 11 receives shallow cup-shaped blanks 30 that are disposed side-by-side in gravity chute 26. Blanks 30 exit one at a time from the bottom of chute 26 and are transformed into elongated one piece can bodies 32 (FIG. 2). That is, the cylindrical sidewall of cup 30 is elongated and ironed by passing through a series of ring-shaped dies 33*a*–33*d*, being driven into ram 24. During initial forward movement of ram 24 in its working stroke, ram 24 is preceded by blank holder pad 34 (FIGS. 5 and 6). The latter is mounted to movable bend holder frame assembly 98 positioned in front of cross-arm 99 of main frame 20. As assembly 98 moves forward relative to cross-arm 99 from its return or retracted position of FIG. 5 to its clamping position of FIG. 6, pad 34 enters blank 30 through its rear facing open end thereof (FIG. 6) and clamps bottom 31 of blank 30 against the first die ring 33*a*. Then ram 24 moves through assembly 98 including central guide bore 35 of pad 34, engages bottom 31 and drives it forward through die rings 33*a*–33*d* and finally into engagement with doming formation 36 (FIG. 2).

Figure 3:
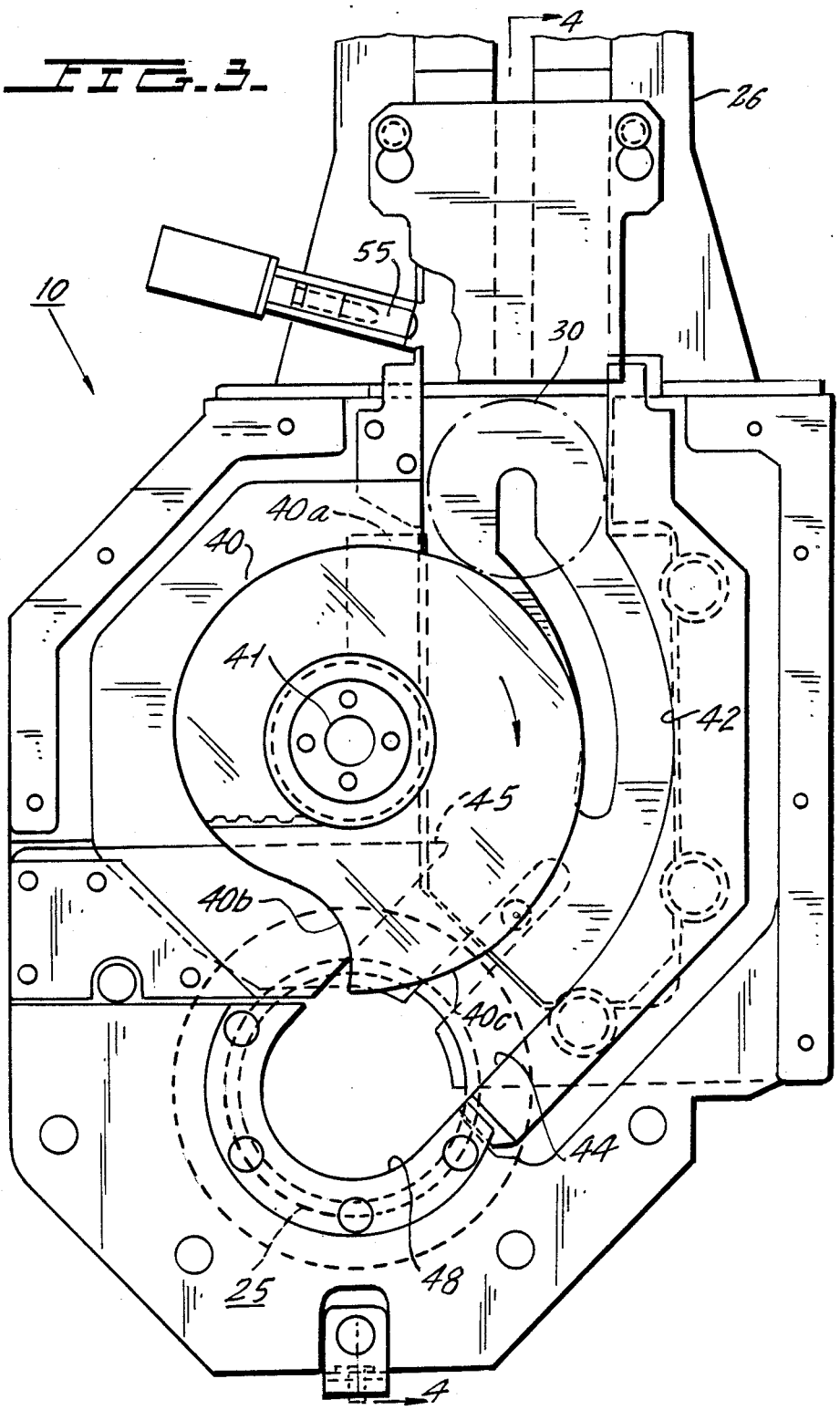
FIG. 3 is an enlarged rear elevation of the rotary feed mechanism.
Figure 4:
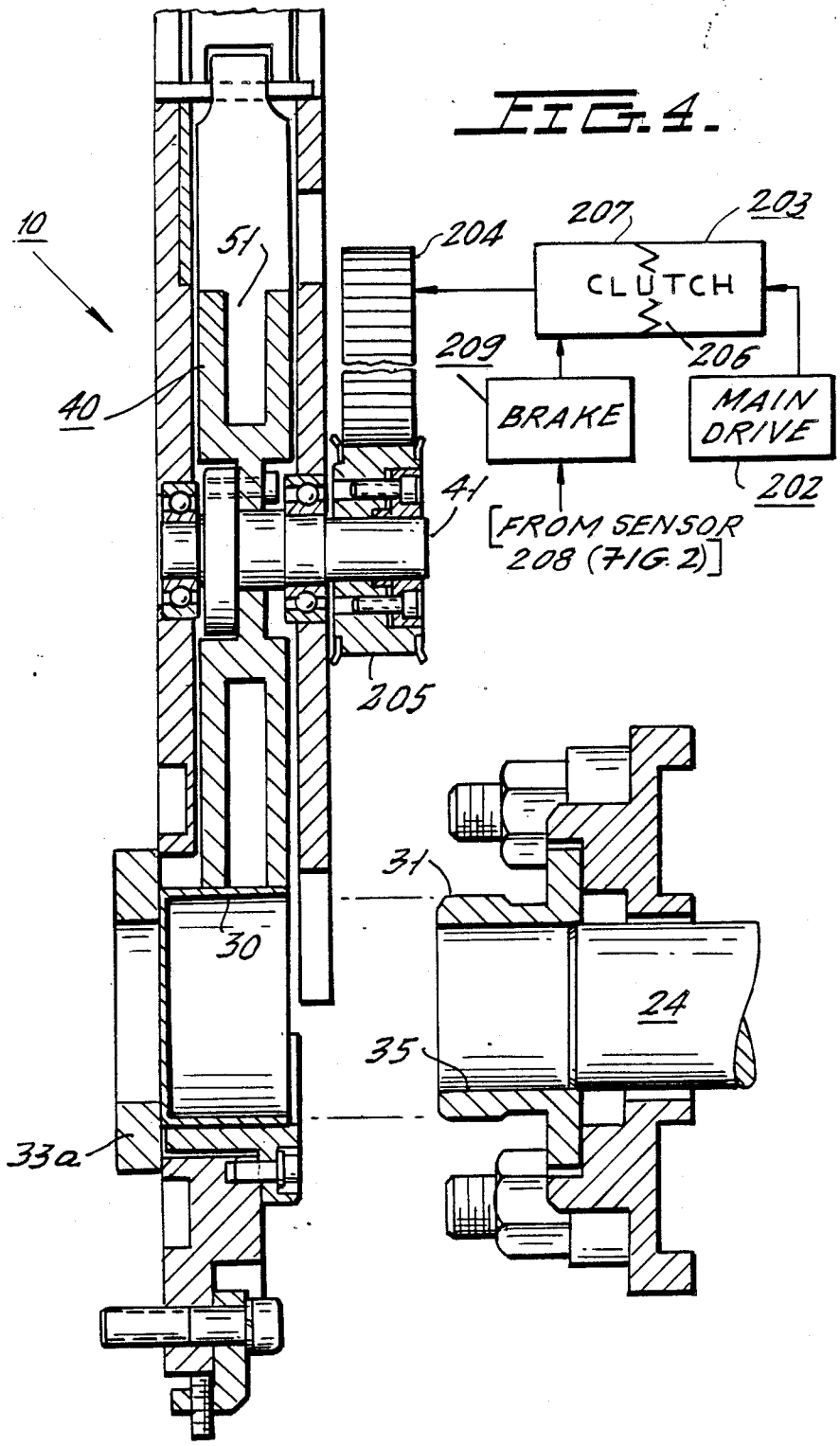
FIG. 4 is a cross-section taken through line 4—4 of FIG. 3 looking in the direction of arrows 4—4.
Figure 9:
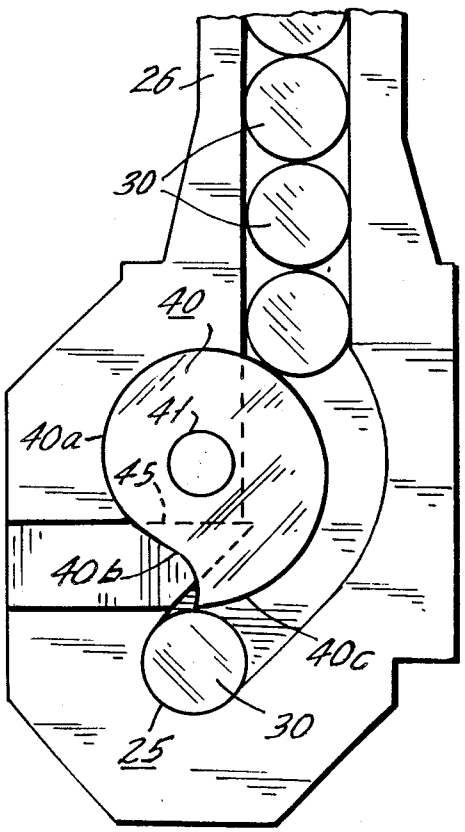
FIGS. 7, 8 and 9 are simplified rear elevations of the rotary feed mechanism showing various positions for a blank as it leaves the gravity feed chute (FIG. 7) until it is in engagement with the registry means at the receiving station and disposed for engagement by the movable tool elements (FIG. 9).
Figure 8:
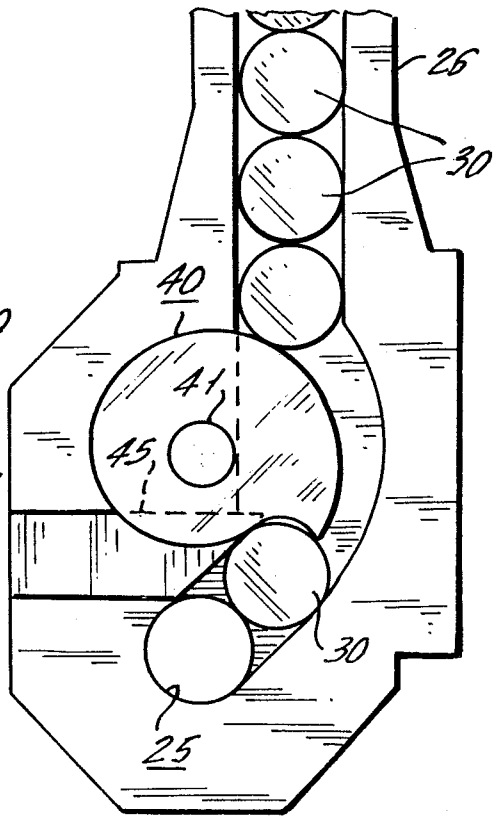
Figure 7:
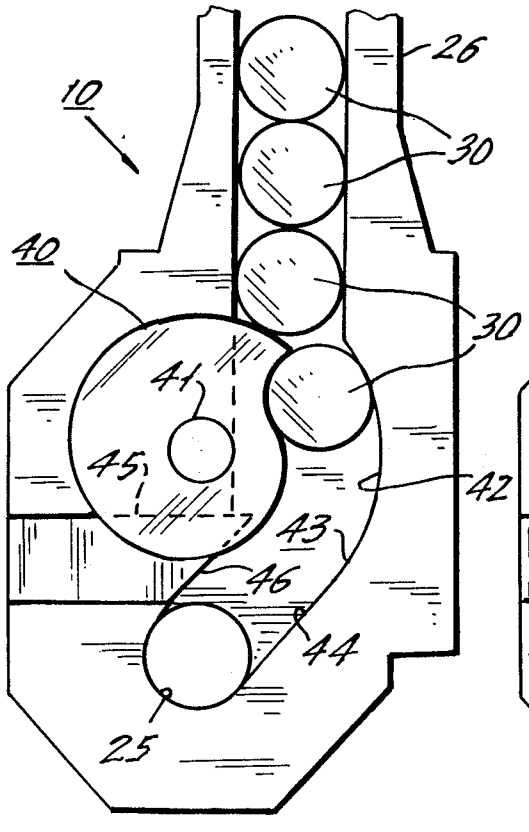

With particular reference to FIGS. 3, 4 and 7 through 9, it is seen that feed mechanism 10 includes rotary feed member 40 that is keyed to continuously rotating horizontal shaft 41 The periphery of feed member 40 is disposed to move below and in proximity to the bottom or exit end of chute 26. Blank 30 shown in phantom in FIG. 3 is positioned at the bottom of chute 26 for removal through the exit thereof. At this time blank 30 is supported by lead-in surface portion 40*a* along the edge of feed member 40. Lead-in surface portion 40*a* is so shaped that while it supports can 30 as the latter gradually moves downward through the exit of chute 26 Finally, blank 30 is received in pocket 40*b* (FIG. 7) of feed member 40 and is driven along the upper main arcuate portion 42 of guide wall 43. The lower or terminal portion 44 of guide wall 43 is generally straight and generally parallel to edge 46 of stripper 45. Narrow slot 51 (FIG. 4) in the edge of rotating feed member 40 provides clearance for stripper 45. When blank 30 moves between guide portion 44 and edge 46, stripper 45 forces blank 30 out of pocket 40*b*. However, feed member 40 continues to drive blank 30 downward until it reaches receiving station 25 where arcuate indexing or registry formation 48 arrests movement of blank 30 in a position aligned with ram 24 and clamping pad 34 (FIG. 5). While clamping pad 34 moves from the rear position of FIG. 5 to the clamping position of FIG. 6, edge portion 40*c* of member 40 that extends immediately upstream from pocket 40*b* locks blank 30 against registry formation 48 (FIG. 9).

Edge portion 40*c* which constitutes a holding means, is the part of feed member 40 that is most distant from the rotational axis thereof, and shaft 41 is positioned so that no portion of member 40 passes across the feed path of ram 24. This means that the latter cannot engage feed member 40 in the event these elements are out of synchronization.

In the event of a malfunction, solenoid operated plunger 55 (FIG. 3) is actuated to extend into feed chute 26 and stop blanks 30 from moving therethrough While rotary feed member 40 is a single lobe element having a single pocket 40*b*, it is noted that in the absence of size considerations a multilobed, multipocketed feed member may be provided so long as its rotational speed is coordinated with the reciprocating motion of ram 24 and clamping pad 35. The single lobe construction illustrated is appealing in that the feed member 40 and movable tool elements 24 and 35 operate on a one to one basis. That is, for each complete revolution of feed member 40 tool members 24 and 35 move forward and rearward through a complete cycle.

The power to rotate shaft 41 of feed member 40 is supplied by main drive 202 (FIG. 4) which is connected through clutch 203 and a timing belt 204 to normally rotate sprocket 205 that is keyed to shaft 41. When feed member 40 engages blank having an oval sidewall or other defect that causes it to wedge against guide wall 43, the force required to rotate feed member 40 increases. When this required force exceeds a predetermined value the driving connection broken between the input 206 and output 207 of clutch 203 whereby the driving connection between main drive 202 and feed member 40 is broken so that the latter ceases to deliver blanks to receiving station 25.

A braking force is applied automatically to clutch output 207 when the forward or working stroke of ram 24 fails to produce a properly formed elongated can body 32. For example, when a blank 30 has a defective sidewall, it is not uncommon for the front of blank 30 to separate from the remainder (rear) of blank 30 as ram 24 moves forward with this remainder of blank 30 remaining at the receiving station 25 to interfere with entry of the next blank 40 into station 25. More particularly, when ram 24 reaches the end of its forward stroke sensor 208 (FIG. 2) determines whether cam body 32 is defective by detecting if its sidewall is too short. If this defect condition is found to exist sensor 208 generates a signal which actuates brake 209 which applies an overboard force to clutch output 207. This breaks the driving connection between clutch input 206 and clutch output 207 so that the driving connection between main drive 202 and feed member 40 is broken.

Since the rotating feed member 40 has relatively low inertia the braking force applied to clutch output 207 coupled with removal of driving power from the latter causes feed member 40 to stop very quickly, say approximately a half cycle. Because the reciprocating ram 24 has relatively high inertia, it takes much longer to stop, say approximately one and a half cycles after driving power is removed therefrom and a braking force is applied thereto However, this failure of ram 24 to stop instantaneously does not cause additional damage. That is, for a second time ram 24 will merely pass through the rear portion of blank 30 that was left behind at receiving station 25.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. Apparatus for processing cup-like circular-sided parts including:

supply means constructed to hold cup-like circular-sided parts disposed side-by-side in a moving stack;

indexing means for locating a circular-sided part at a receiving station for engagement by a movable section of a tool means;

feeding means for separating the most downstream cup-like part in the stack from the remaining cup-like parts in the stack and transferring circular-sided parts one at a time from said supply means to said receiving station;

tool means including a movable section mounted to move along a path that extends through said receiving station;

first means for reciprocating said movable section along said path between a forward position and a return position behind said station, with said movable section when moving forward in a working stroke engaging a circular-sided part taken from said stack and disposed at said station;

said feeding means including a rotatably mounted member having pocket means to receive circular-sided parts from said supply means;

second means for continuously rotating said member about an axis in coordination with movement of said movable section whereby a circular-sided part is disposed at said station for each working stroke of said movable section of said tool means;

said supply means including an exit through which cup-like parts leave one at a time;

a guide for directing circular-sided parts from said exit to said indexing means;

said member including an arcuate lead-in formation extending from said pocket means in the rotational direction for said member;

said lead-in formation receding gradually from said exit toward said axis as said lead-in formation moves past said exit to support and control movement of a cup-like part as it moves through said exit into said pocket means.

2. Apparatus as set forth in claim 1 in which the member also includes a holding formation to maintain a circular-sided part engaged with said indexing means until engaged by said movable section;

said holding formation being along an edge of said member and extending upstream from said pocket means in relation to direction of rotation for said member.

3. Apparatus as set forth in claim 2 in which the guide includes a main arcuate section.

4. Apparatus as set forth in claim 3 in which the exit is positioned above the indexing means.

5. Apparatus as set forth in claim 2 also including stripper means to remove parts from said pocket means before such parts reach said indexing means.

6. Apparatus as set forth in claim 5 in which the feeding means drives circular-sided parts while they move along said guide and even after they are removed from said pocket means by said stripper means.

7. Apparatus as set forth in claim 1 in which, for all positions thereof, the rotatably mounted member it is clear of said path.

8. Apparatus as set forth in claim 1 in which the rotatably mounted member comprises a single lobe and the pocket means comprises a single pocket.

9. Apparatus as set forth in claim 8 in which the rotatably mounted member moves through a single revolution each time the movable section moves through its working stroke and back to said return position.

10. Apparatus as set forth in claim 1 in which the circular-sided parts are cups that have rear facing entrances and the movable section of the tool means includes a ram that enters the cups during the forward stroke of the movable section.

11. Apparatus as set forth in claim 10 in which the tool means also includes a stationary section disposed along said path forward of said station to cooperate with said ram in operating on said cups.

12. Apparatus as set forth in claim 11 in which the stationary section includes die means that encircles said path and engages the exterior of each cup along its sidewall as such cup is driven forward by the ram;

said die means including a plurality of die sections disposed in a row extending forward from the receiving station; each of said sections having an aperture through which said path extends;

each of said apertures having a different diameter and being arranged so that each aperture is smaller in diameter than those apertures therebehind and is larger in diameter than those apertures forward thereof.

13. Apparatus as set forth in claim 10 in which the second means includes clutch means which operates automatically to interrupt driving engagement between said second means and said member when power required to drive the latter exceeds a predetermined level.

14. Apparatus as set forth in claim 13 also including third means for automatically operating said clutch means to interrupt driving engagement between said second means and said member upon detecting that travel of said movable section to said forward position has failed to convert a circular-sided part to a properly formed product.

15. Apparatus as set forth in claim 1 in which the member rotates about an axis that is parallel to the path and the circular sided parts in moving from said supply means to said receiving station travel in a plane that is generally perpendicular to said path.

16. Apparatus as set forth in claim 1 also including stripper means to remove parts from said pocket means before such parts reach said indexing means.

17. Apparatus as set forth in claim 16 in which the feeding means drives parts while they move along said guide and while they are being removed from said pocket means by said stripper means.

18. Apparatus as set forth in claim 17 in which, for all positions thereof, the rotatably mounted member it is clear of said path.

19. Apparatus as set forth in claim 18 in which the rotatably mounted member comprises a single lobe and the pocket means comprises a single pocket;

said rotatably mounted member moving through a single revolution each time the movable section moves through its working stroke and back to said return position.

20. Apparatus as set forth in claim 19 in which the circular-sided parts are cups that have rear facing entrances and the movable section of the tool means includes a ram that enters the cups during the forward stroke of the movable section;

said tool means also including a stationary section disposed along said path forward of said station to cooperate with said ram in operating on said cups;

said stationary section including die means that encircles said path and engages the exterior of each cup along its sidewall as such cup is driven forward by the ram;

said die means including a plurality of die sections disposed in a row extending forward from the receiving station; each of said sections having an aperture through which said path extends;

each of said apertures having a different diameter and being arranged so that each aperture is smaller in diameter than those apertures therebehind and is larger in diameter than those apertures forward thereof.

21. Feeding apparatus for moving cylindrical cups one at a time to a location where each of them dwells in a position to have its sidewall elongated by being operated upon by a reciprocating tool during its working stroke which extends through such location;

said feeding apparatus including a chute constructed to position cups as they move side-by-side in a stack, first means defining a receiving station remote from said chute, and a rotatably mounted member for separating the most downstream cup of the stack from the cups upstream of the most downstream cup and then transferring the latter from said chute to said receiving station;

said rotatably mounted member having pocket means to receive cups from said chute; and second means for continuously rotating said member about an axis in coordination with operation of a reciprocating tool means whereby a cup is delivered to and dwells at said location for each working stroke of such reciprocating tool means.

22. Apparatus as set forth in claim 21 also including:

an exit through which cups leave the supply means one at a time;

a guide for directing cups from said exit to indexing means at said location;

said member including an arcuate lead-in formation extending from said pocket means in the rotational direction for said member;

said lead-in formation receding gradually from said exit toward said axis as said lead-in formation moves past said exit to support and control movement of a cup as it moves out of said exit into said pocket means.

23. Apparatus as set forth in claim 22 in which there is a guide for directing cups from said exit to an indexing means at said location;

said member including a holding formation to maintain a cup engaged with said indexing means until engaged by a reciprocating tool means; and the holding formation is along an edge of said member and extends upstream from said pocket means in relation to direction of rotation for said member.

24. Apparatus as set forth in claim 23 in which the guide includes a main arcuate section.

25. Apparatus as set forth in claim 24 in which the exit is positioned above the indexing means.

26. Apparatus as set forth in claim 23 also including stripper means to remove cups from said pocket means before such cups reach said indexing means.

27. Apparatus as set forth in claim 26 in which the member drives cups while they move along said guide and even after they are being removed from said pocket means by said stripper means.

28. Apparatus as set forth in claim 22 in which, for all positions thereof, the rotatably mounted member is clear of a path for reciprocating tool means that engages a cup which has been delivered to said receiving station by said member.

29. Apparatus as set forth in claim 22 in which the rotatably mounted member comprises a single lobe and the pocket means comprises a single pocket.

* * * * *